US012145710B1

(12) United States Patent
Groeschel et al.

(10) Patent No.: US 12,145,710 B1
(45) Date of Patent: Nov. 19, 2024

(54) MARINE DRIVES HAVING RIGID COOLING WATER INTAKE AND DRAIN MECHANISM

(71) Applicant: Brunswick Corporation, Mettawa, IL (US)

(72) Inventors: John A. Groeschel, Theresa, WI (US); Chetan Avinash Dharmadhikari, North Fond Du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 133 days.

(21) Appl. No.: 17/945,266

(22) Filed: Sep. 15, 2022

(51) Int. Cl.
*B63H 21/38* (2006.01)

(52) U.S. Cl.
CPC ..... *B63H 21/383* (2013.01)

(58) Field of Classification Search
CPC .... B63H 21/383; B63H 20/28; B63H 20/285; F01P 3/202
See application file for complete search history.

(56) References Cited

U.S. PATENT DOCUMENTS 3,181,494 A * 5/1965 Kiekhaefer ..... B63H 20/20 440/88 P
3,626,467 A * 12/1971 Mazziotti ..... B63H 20/12 440/61 R
4,699,598 A * 10/1987 Bland ..... F01P 11/04 123/41.14
4,955,837 A * 9/1990 Yoshimura ..... F01P 3/202 440/88 P
5,358,435 A * 10/1994 Rodskier ..... B63H 20/12 440/61 R
6,273,771 B1 8/2001 Buckley et al.
9,334,034 B1 5/2016 Waldvogel et al.
9,446,828 B1 9/2016 Groeschel et al.
10,800,502 B1 10/2020 Alby et al.
2010/0323565 A1* 12/2010 Bernogger ..... B63H 20/20 440/53

* cited by examiner

*Primary Examiner* — Andrew Polay
(74) *Attorney, Agent, or Firm* — Andrus Intellectual Property Law, LLP

(57) ABSTRACT

A marine drive is configured for propelling a marine vessel in a body of water. The marine drive has a transom bracket assembly configured to mount the marine drive to the marine vessel, a drive assembly coupled to the transom bracket assembly and configured to generate a thrust force in the body of water, the drive assembly being trimmable up and down relative to the transom bracket assembly, a cooling water pump configured to pump cooling water from the body of the water for cooling at least one component of the marine drive, and a rigid cooling water conduit extending from the drive assembly to the transom bracket assembly, the rigid cooling water conduit being configured to convey the cooling water from the drive assembly to the cooling water pump.

20 Claims, 9 Drawing Sheets

MARINE DRIVES HAVING RIGID COOLING WATER INTAKE AND DRAIN MECHANISM

FIELD

The present disclosure relates to marine drives for propelling marine vessels in water, and particularly to intake of cooling water for cooling said marine drives.

BACKGROUND

The following U.S. Patents are incorporated herein by reference in entirety.

U.S. Pat. No. 6,273,771 discloses a control system for a marine vessel which incorporates a marine propulsion system for attachment to a marine vessel and connection signal communication to a serial communication bus and a controller. A plurality of input devices and output devices are also connected in signal communication with the communication bus. A bus access manager such as a CAN Kingdom network is connected in signal communication with the controller to regulate the incorporation of additional devices in signal communication with the bus. The input and output devices can each transmit messages to the serial communication bus for receipt by other devices.

U.S. Pat. No. 9,334,034 discloses a system for combined control of steering and trim of a marine engine unit. The system includes a steering apparatus generating steering signals, a trim control generating trim signals, an electronic unit receiving steering trim and cylinder position signals and sending output signals. Port and starboard hydraulic cylinders are connected to port and starboard joints to provide movement of the engine unit. The port and starboard joints enable movement of the engine unit vertically and horizontally when the port and starboard hydraulic cylinders are extended and retracted to provide a full range of steering and trim movement of an engine unit.

U.S. Pat. No. 9,446,828 discloses an apparatus for mounting a marine drive to a hull of a marine vessel. An outer clamping plate faces an outside surface of the hull and an inner clamping plate faces an opposing inside surface of the hull. A marine drive housing extends through the hull. The marine drive housing is held in place with respect to the hull by at least one vibration dampening sealing member which is disposed between the inner and outer clamping plates. A first connector clamps the outer clamping plate to the outside surface of the hull and a second connector clamps the inner clamping plate to the outer clamping plate. The inner and outer clamping plates are held at a fixed distance from each other so that a consistent compression force is applied to the vibration dampening sealing member.

U.S. Pat. No. 10,800,502 discloses an outboard motor having a powerhead which causes rotation of a driveshaft, a steering housing located below the powerhead, wherein the driveshaft extends from the powerhead into the steering housing; and a lower gearcase located below the steering housing and supporting a propulsor shaft which is coupled to the driveshaft so that rotation of the driveshaft causes rotation of the propulsor shaft. The lower gearcase is steerable about a steering axis with respect to the steering housing and powerhead.

SUMMARY

This Summary is provided to introduce a selection of concepts which are further described below in the Detailed Description. This Summary is not intended to identify key or essential features of the claimed subject matter, nor is it intended to be used as an aid in limiting the scope of the claimed subject matter.

In non-limiting examples disclosed herein, a marine drive is for propelling a marine vessel in a body of water. The marine drive has a transom bracket assembly configured to mount the marine drive to the marine vessel, a drive assembly coupled to the transom bracket assembly and configured to generate a thrust force in the body of water, the drive assembly being trimmable up and down relative to the transom bracket assembly, a cooling water pump configured to pump cooling water from the body of the water for cooling at least one component of the marine drive, and a rigid cooling water conduit extending from the drive assembly to the transom bracket assembly, the rigid cooling water conduit being configured to convey the cooling water from the drive assembly for cooling at least one component of the marine drive.

In non-limiting examples, the rigid cooling water conduit is lengthened upon trimming of the drive assembly up relative to the transom bracket assembly and the rigid cooling water conduit is shortened upon trimming of the drive assembly down relative to the transom bracket assembly. The rigid cooling water conduit may be telescopically extendable and retractable.

In non-limiting examples, the rigid cooling water conduit may comprises a first conduit member coupled to the drive assembly and a second conduit member coupled to the transom assembly, wherein the first conduit member and second conduit member are telescopically coupled to each other to facilitate lengthening of the rigid cooling water conduit upon trimming of the drive assembly up relative to the transom assembly and also to facilitate shortening of the rigid cooling water conduit upon trimming of the drive assembly down relative to the transom assembly.

In non-limiting examples, the first conduit member comprises a first rigid hose and the second conduit member comprises a second rigid hose, and a first one of the first and second rigid hoses extends into a different second one of the first and second rigid hoses at a telescoping joint. The first rigid hose may comprise a first end pivotably coupled to the drive assembly and an opposite, second end telescopically coupled to the second rigid hose. The second rigid hose may comprise a first end which is telescopically coupled to the first rigid hose at a telescoping joint and an opposite, second end which is pivotably coupled to the transom bracket assembly.

The rigid cooling water conduit may have a first end which is pivotably coupled to the drive assembly and an opposite, second end which is pivotably coupled to the transom bracket assembly. A first swivel joint may pivotably couples the rigid cooling water conduit to the drive assembly and a second swivel joint may pivotably couples the rigid cooling water conduit to the transom bracket assembly.

In non-limiting examples, the marine drive may comprise a drain mechanism for draining cooling water from the rigid cooling water conduit, wherein the drain mechanism is configured such that trimming the drive assembly up relative to the transom bracket assembly automatically opens the drain mechanism and permits cooling water to drain by gravity from the rigid cooling water conduit. A swivel joint may pivotably couples the rigid cooling water conduit to the transom bracket assembly, wherein the swivel joint comprises the drain mechanism. The swivel joint may comprise a mounting boss and a swivel housing which is rotatable about the mounting boss. Trimming the drive assembly up relative to the transom bracket assembly rotates the swivel housing in a first direction about the mounting boss, which opens the drain mechanism. Trimming the drive assembly down relative to the transom bracket assembly rotates the swivel housing in an opposite, second direction about the mounting boss, which closes the drain mechanism.

BRIEF DESCRIPTION OF THE DRAWINGS

The present disclosure includes the following figures.

DETAILED DESCRIPTION

Typically, various hoses, wires, cables, or the like extend between a marine vessel and a marine drive coupled to the vessel's transom. For example, a cooling system may include flexible conduits that extend from the marine drive, through the transom, to a heat exchanger on the marine vessel. During research and development in the field of marine drives, the present inventors determined that such flexible conduits are subject to bending and abrasion that may damage the conduits over extended periods of time. Repetitive movement may cause the conduits to rub against the transom bracket, the transom itself, or other parts of the marine vessel or marine drive support structure resulting in chafing and damaging the flexible conduits. Moreover, lengthy conduits extending between the marine drive and the marine vessel can affect the styling of the marine drive and can otherwise be inconvenient for a number of reasons. Through their research and experimentation, the inventors determined that it would be advantageous to provide a rigid conduit with an adjustable length between a marine drive and a marine vessel. The present disclosure is a result of the present inventors' efforts in this regard.

Figure 1:
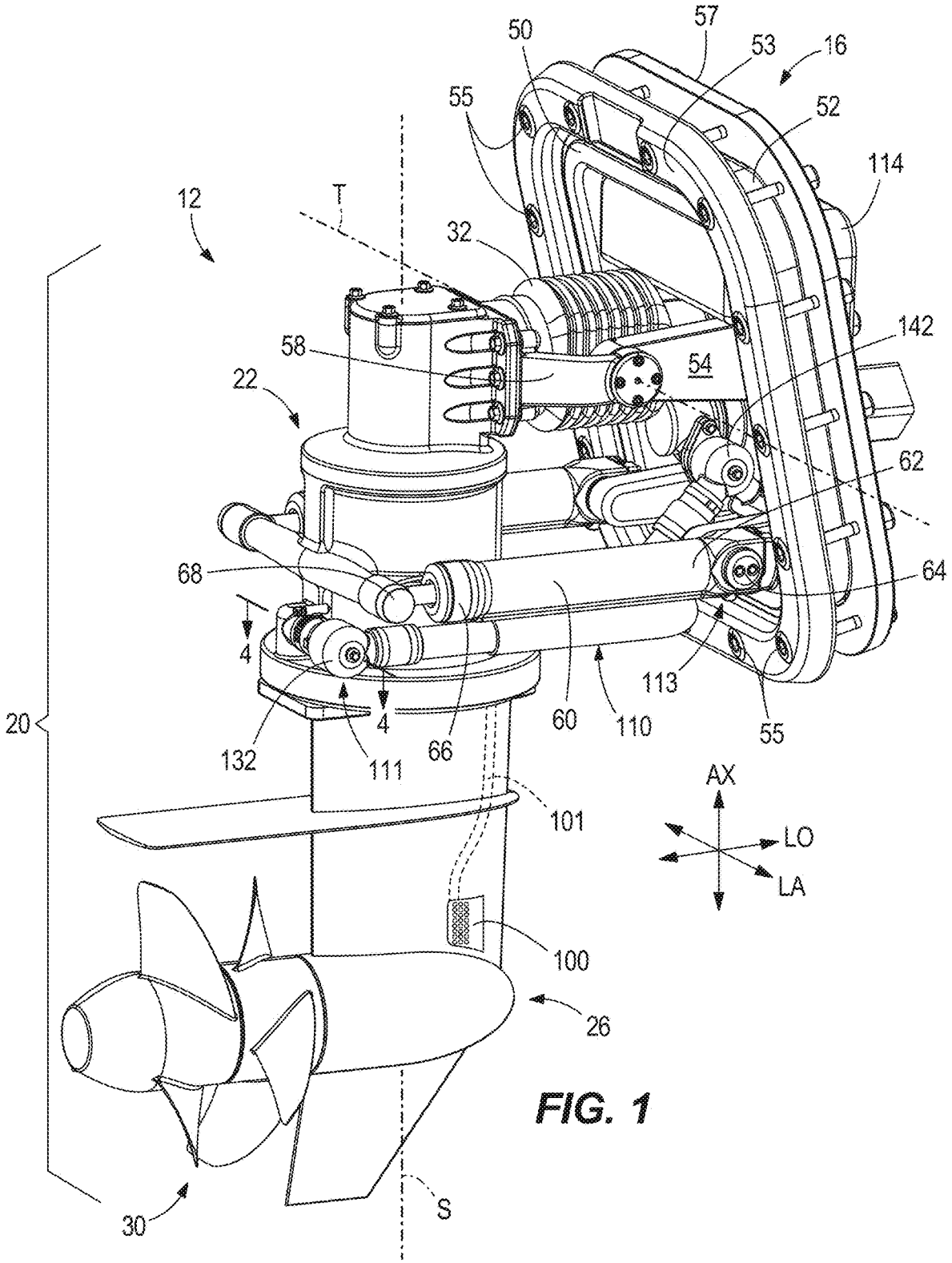
FIG. 1 is a starboard side perspective view of a marine drive according to the present disclosure.

FIG. 1 depicts a marine drive 12 for propelling a marine vessel in a body of water. In the illustrated embodiment, the marine drive 12 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. The marine drive 12 has a transom bracket assembly 16, which supports the marine drive 12 on the transom (not shown) of a marine vessel, and a drive assembly 20 configured to generate a thrust force in the body of water. As will be further explained below, the drive assembly 20 is coupled to the transom bracket assembly 16 such that the drive assembly 20 is trimmable up and down relative to the transom bracket assembly 16, including in non-limiting examples wherein the drive assembly 20 is raised completely out of the water.

The drive assembly 20 has a driveshaft housing 22 and a gearcase housing 26 steerable about a steering axis S relative to the driveshaft housing 22. The driveshaft housing 22 houses a driveshaft (not shown), and the gearcase housing 26 containing one or more output shaft(s), e.g., one or more propulsor shaft(s) operatively connected to the driveshaft. The output shaft(s) extends from the rear of the gearcase housing 26 and support one or more propulsors(s) 30 configured to generate thrust in the water for propelling the marine vessel. In the illustrated example, propulsor(s) 30 include two counter-rotating propellers. However this is not limiting and the present disclosure is applicable to other arrangements, including arrangements wherein one or more output shaft(s) are not counter-rotating and/or wherein the one or more output shaft(s) extend from the front of the gearcase housing 26, and/or wherein the propulsor(s) 30 include one or more impellers and/or any other mechanism for generating a propulsive force in the water. A universal joint 32 couples a motor (not shown) on the marine vessel to the driveshaft 24 so that operation of the motor causes rotation of the driveshaft 24, which in turn causes rotation of the output shaft(s) and the propulsor(s) 30. The universal joint 32 is also advantageously configured to facilitate trimming of the drive assembly 20, for example during periods of non-use. Universal joints or constant velocity (CV) joints facilitating trimming of a marine drive are conventional and well known in the art. Reference is made to U.S. Patent Application No. 63/324,251 which discloses suitable examples.

With continued reference to FIG. 1, the transom bracket assembly 16 has a rigid mounting plate 50, a vibration dampening (e.g., rubber or other pliable or resilient material) mounting ring 52, and a rigid mounting ring 53 which is fastened to the transom 18 by fasteners 55 and a fastening ring 57 to couple the vibration dampening mounting ring 52 and rigid mounting plate 50 to the transom 18. A pair of rigid mounting arms 54 extends rearwardly from the rigid mounting plate 50 and is pivotably coupled to a rigid, U-shaped mounting bracket 58 extending forwardly from the top of the driveshaft housing 22. The pivot joint between the mounting arms 54 and mounting bracket 56 defines a trim axis T about which the drive assembly 20 is pivotably (trimmable), up and down relative to the transom bracket assembly 16. The type and configuration of transom bracket assembly 16 can vary from what is shown. In other examples, the transom bracket assembly 16 is configured according to the examples disclosed in the above-incorporated U.S. Pat. No. 9,446,828.

Figure 6:
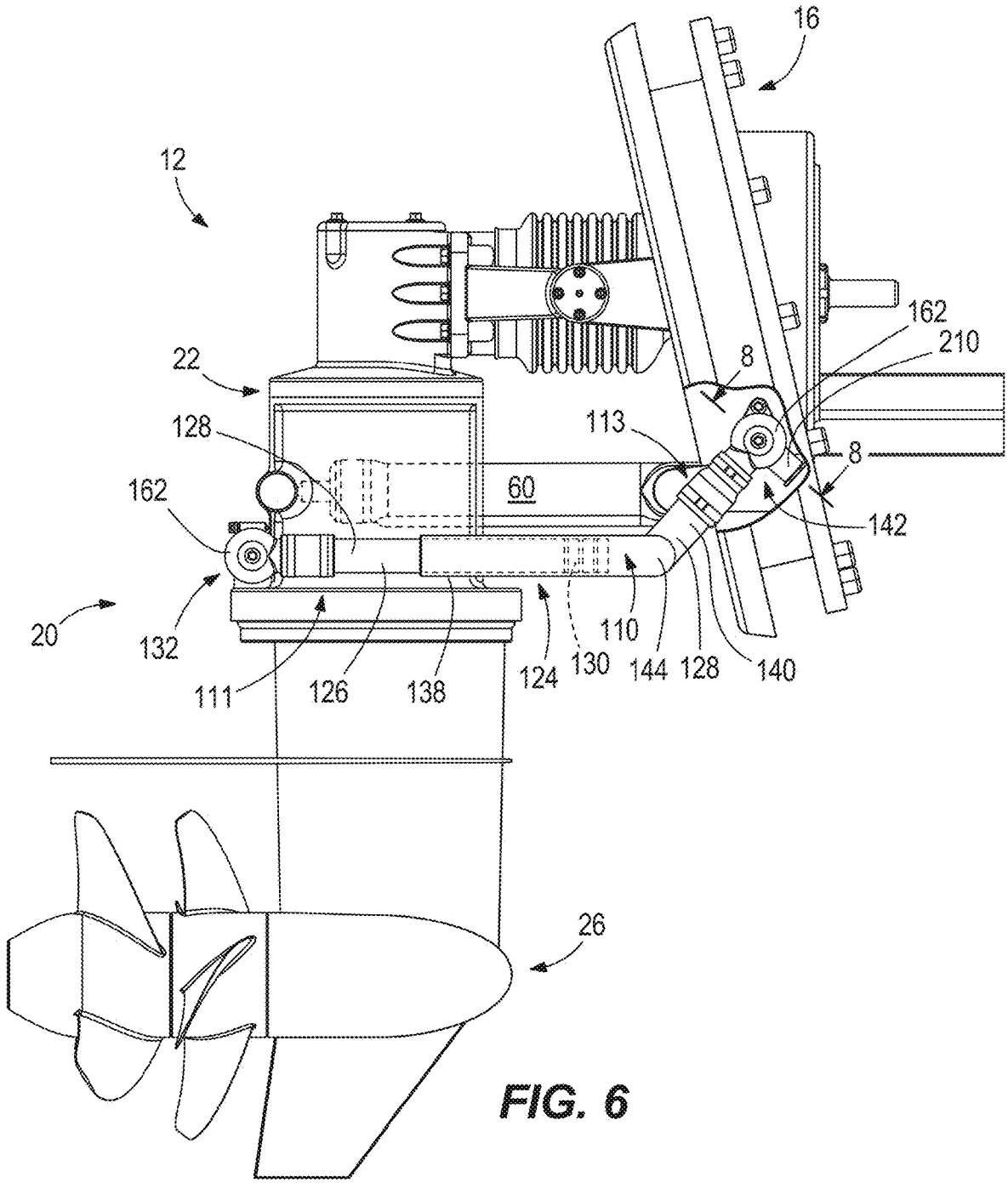
FIG. 6 is a starboard side view of the marine drive with the drive assembly trimmed to a lowered position.
Figure 7:
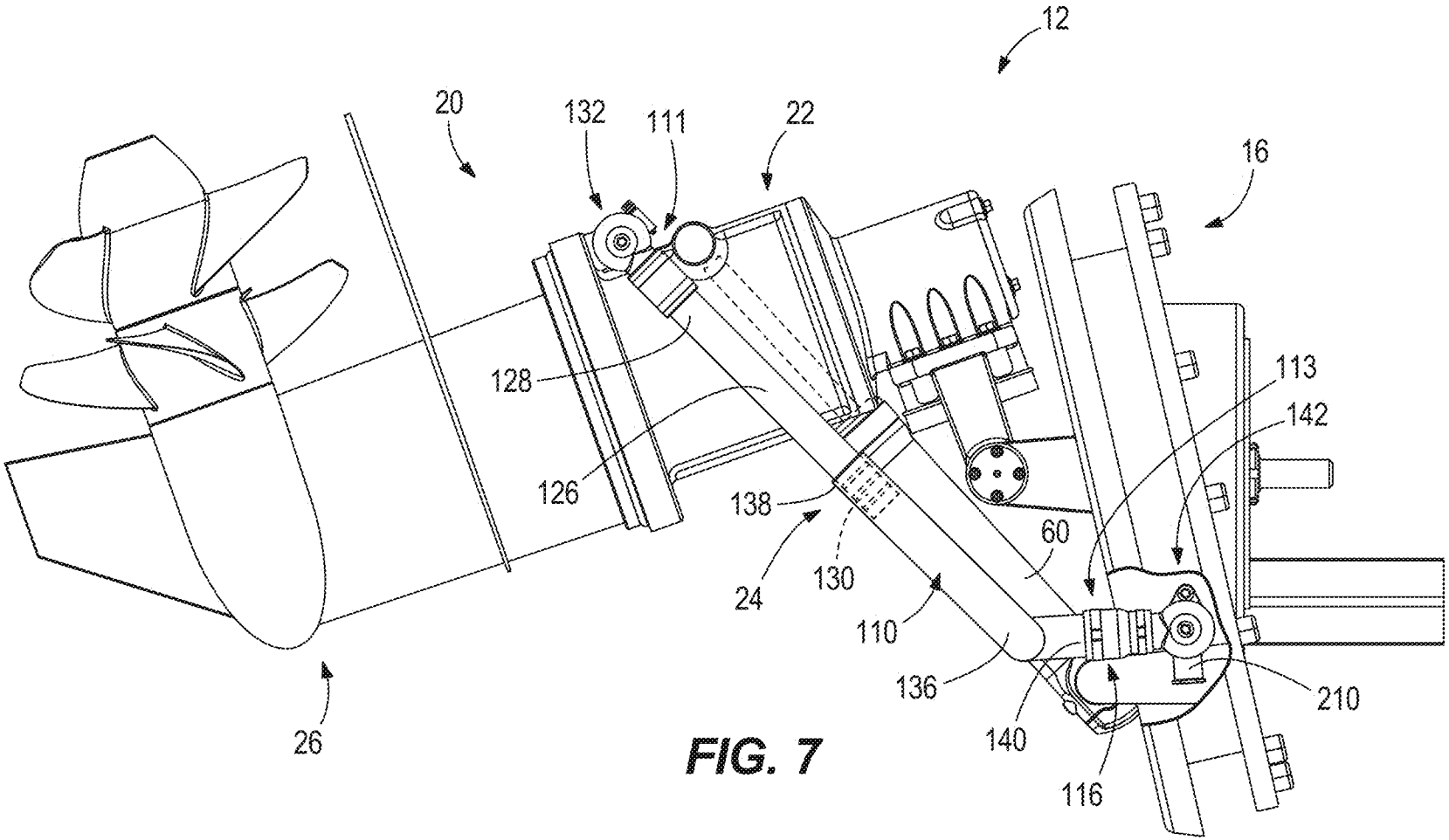
FIG. 7 is a starboard side view of the marine drive of FIG. 6 with the drive assembly trimmed to a raised position.
Figure 8:
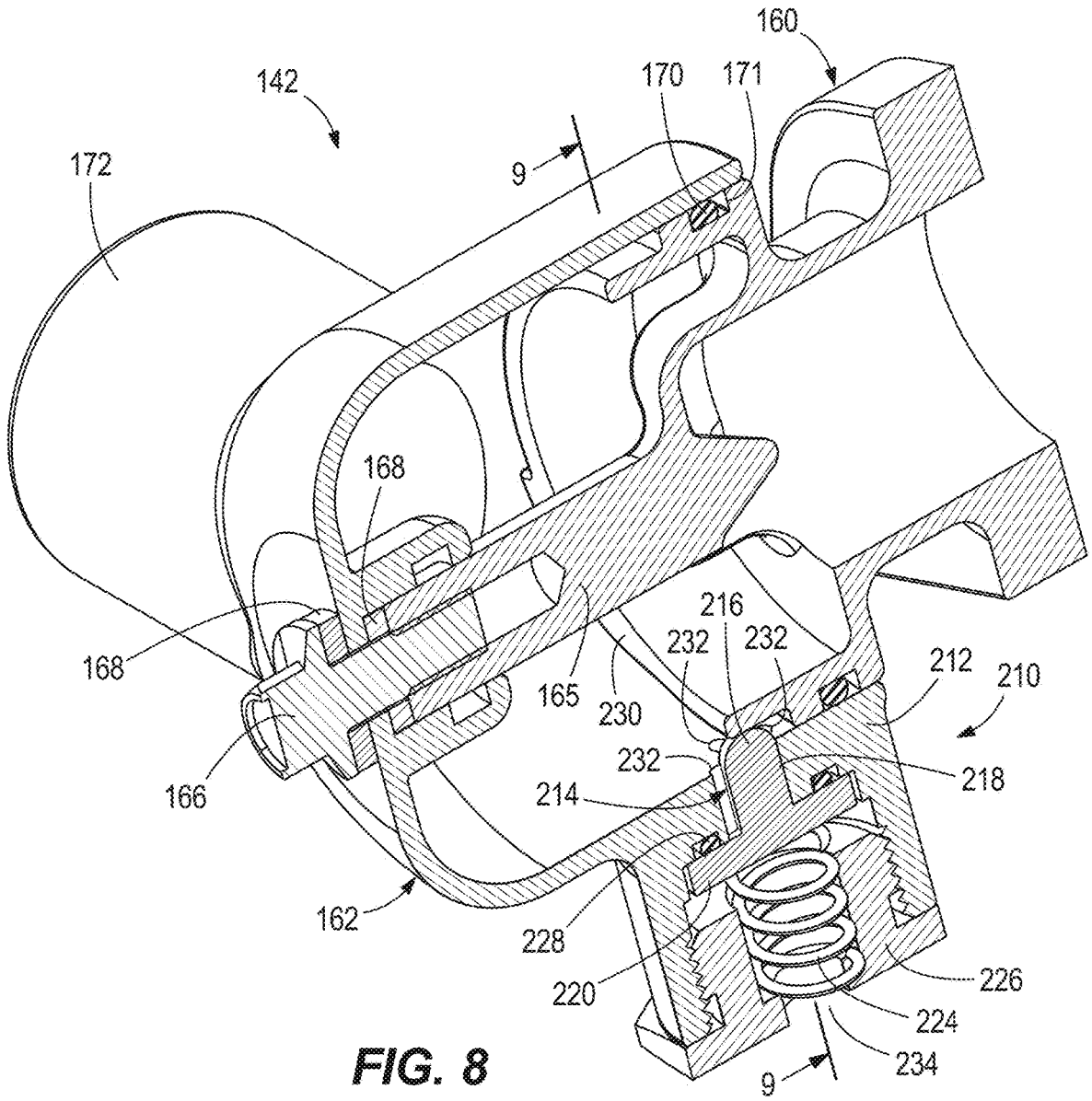
FIG. 8 is a cross sectional view of a swivel joint including a drain mechanism taken at section 8-8 in FIG. 6.

Trim cylinders 60 are located on opposite sides of the transom bracket assembly 16. The trim cylinders 60 have a first end 62 pivotably coupled to the rigid mounting plate 50 at a first pivot joint 64 and an opposite, second end 66 pivotably coupled to the drive assembly 20 at a second pivot joint 68. A hydraulic actuator (not shown) is mounted to the interior of the rigid mounting plate 50. The hydraulic actuator is hydraulically coupled to the trim cylinders 60 via a least one internal passage through the transom bracket assembly 16 and the first pivot joint 64, advantageously so that there are no other hydraulic lines located on the exterior of the marine drive 12, or otherwise outside the marine vessel so as to be subjected to wear and/or damage from external elements. The hydraulic actuator is operable to supply hydraulic fluid to the trim cylinders 60 via the noted internal passage to cause extension of the trim cylinders 60 and alternately to cause retraction of the trim cylinders 60. Extension of the trim cylinders 60 pivots (trims) the drive assembly 20 upwardly relative to the transom bracket assembly 16 into a raised position (FIG. 7). Retraction of the trim cylinders 60 pivots (trims) the drive assembly 20 downwardly relative to the transom bracket assembly 16 into a lowered position (FIG. 6). The hydraulic actuator is conventional and known in the art. Suitable examples are disclosed in the above-incorporated U.S. Pat. No. 9,334,034.

Referring to FIGS. 1-4, the marine drive 12 has a cooling system for cooling various components thereof, including for example the motor and/or any other components on the marine drive. In the non-limiting example shown in the drawings, the cooling system includes an open loop cooling circuit for circulating cooling water from the water in which the marine drive 12 is situated and then discharging the cooling water back to the water. The open loop cooling circuit includes an intake inlet 100 on the gearcase housing 26 which is connected to an annular cooling channel 102 (see FIG. 4) defined between a lower annular flange 104 on the lower end of the driveshaft housing 22 and an annular flange 106 on the top of the gearcase housing 26. Reference is made to the above-incorporated U.S. Pat. No. 10,800,502 for further description of a steerable gearcase having an annular cooling channel like the one shown in the present application.

Figure 5:
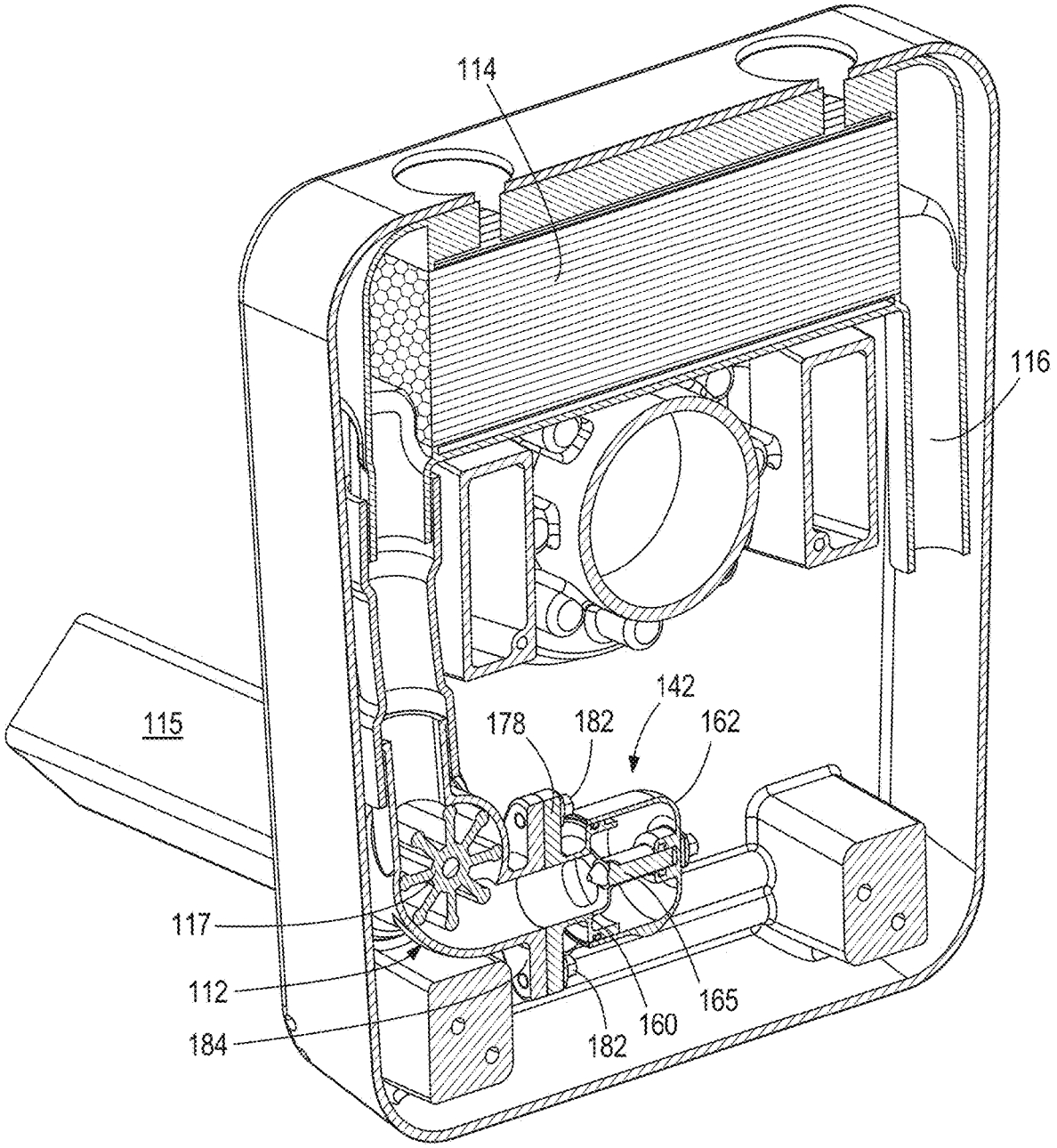
FIG. 5 is a cross sectional view of the cooling system of the marine drive taken at section 5-5 in FIG. 2.

A novel rigid conduit 110 is coupled to the driveshaft housing 22 and is configured to convey the cooling water from the annular cooling channel 102 of the drive assembly 20 for cooling at least one component of the marine drive 12. A cooling water pump 112 is mounted on the outside of the rigid mounting plate 50 and is driven by a pump motor 115. The cooling water pump 112 is configured to generate a suction force which draws the cooling water in through the intake inlet 100, through and internal conduit 101 and the annular cooling channel 102, and through the rigid conduit 110. Referring to FIG. 5, the cooling water pump 112 then pumps the cooling water through the transom bracket assembly 16 to a heat exchanger 114 and then to an outlet 116 shown in FIG. 2. In the illustrated example, the marine drive 12 further includes a closed loop cooling circuit which pumps cooling fluid, such as a mixture of water and ethylene glycol, dielectric oil, and/or any other cooling fluid, through the heat exchanger 114, exchanging heat with the cooling water in the open loop cooling circuit. The mixture of water and ethylene glycol may be circulated past the motor, an associated inverter (not shown), and one or more batteries (not shown), thus cooling these and/or any other components.

Figure 2:
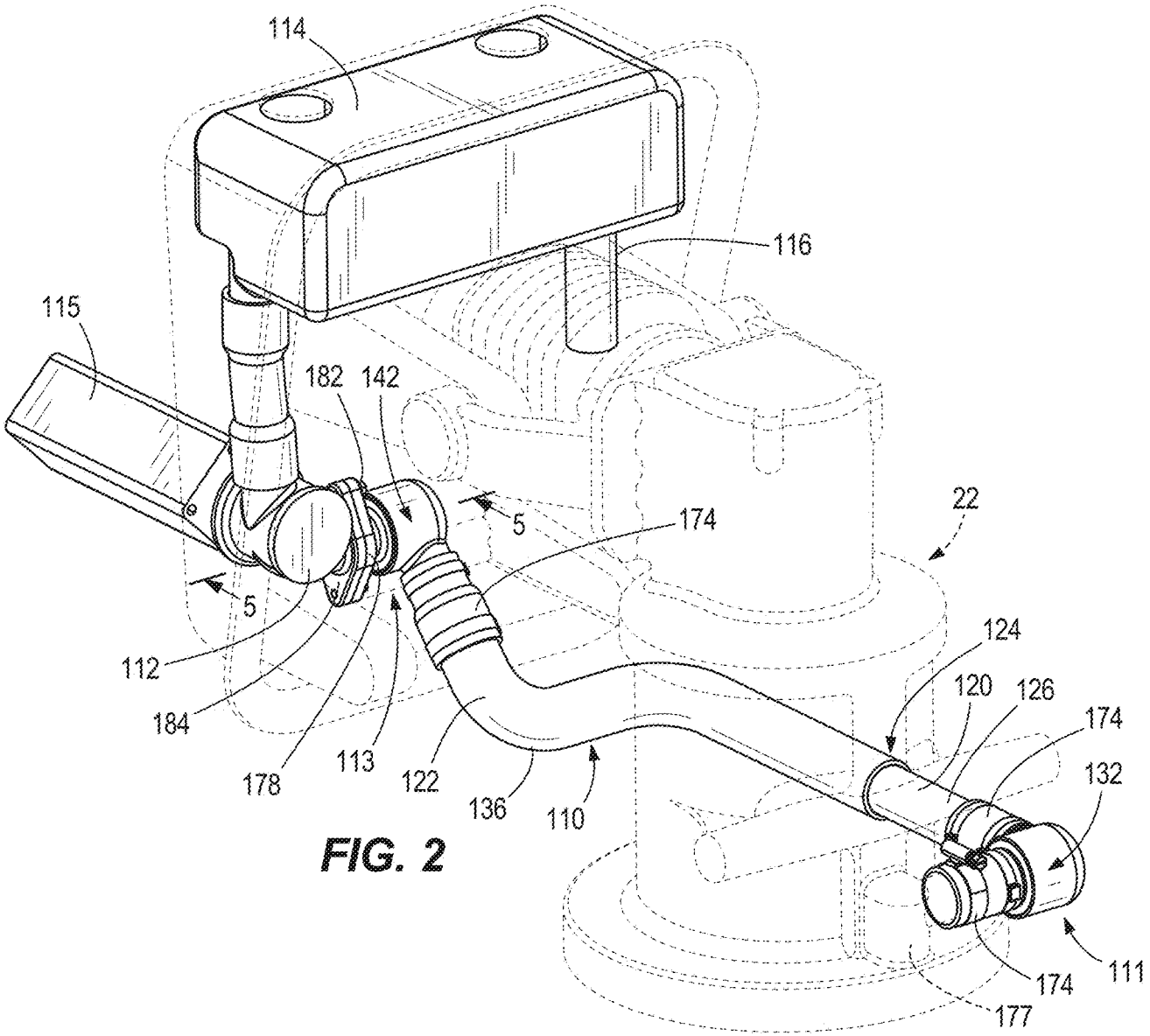
FIG. 2 is a port side perspective view of the cooling system from the marine drive of FIG. 1.
Figure 3:
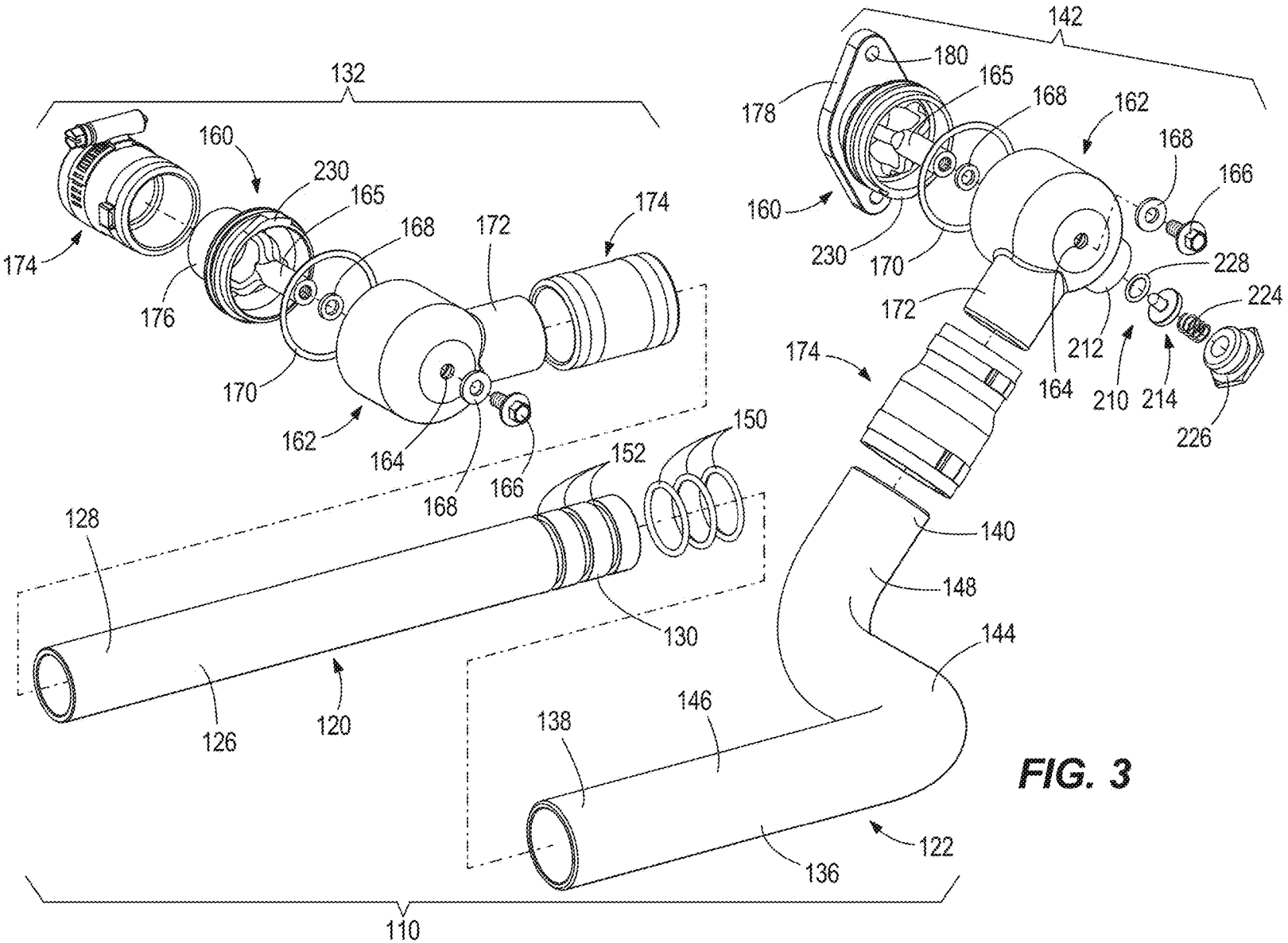
FIG. 3 is an exploded perspective view of the rigid cooling water conduit of FIG. 2 including a first conduit member, a second conduit member and two swivel joints.
Figure 4:
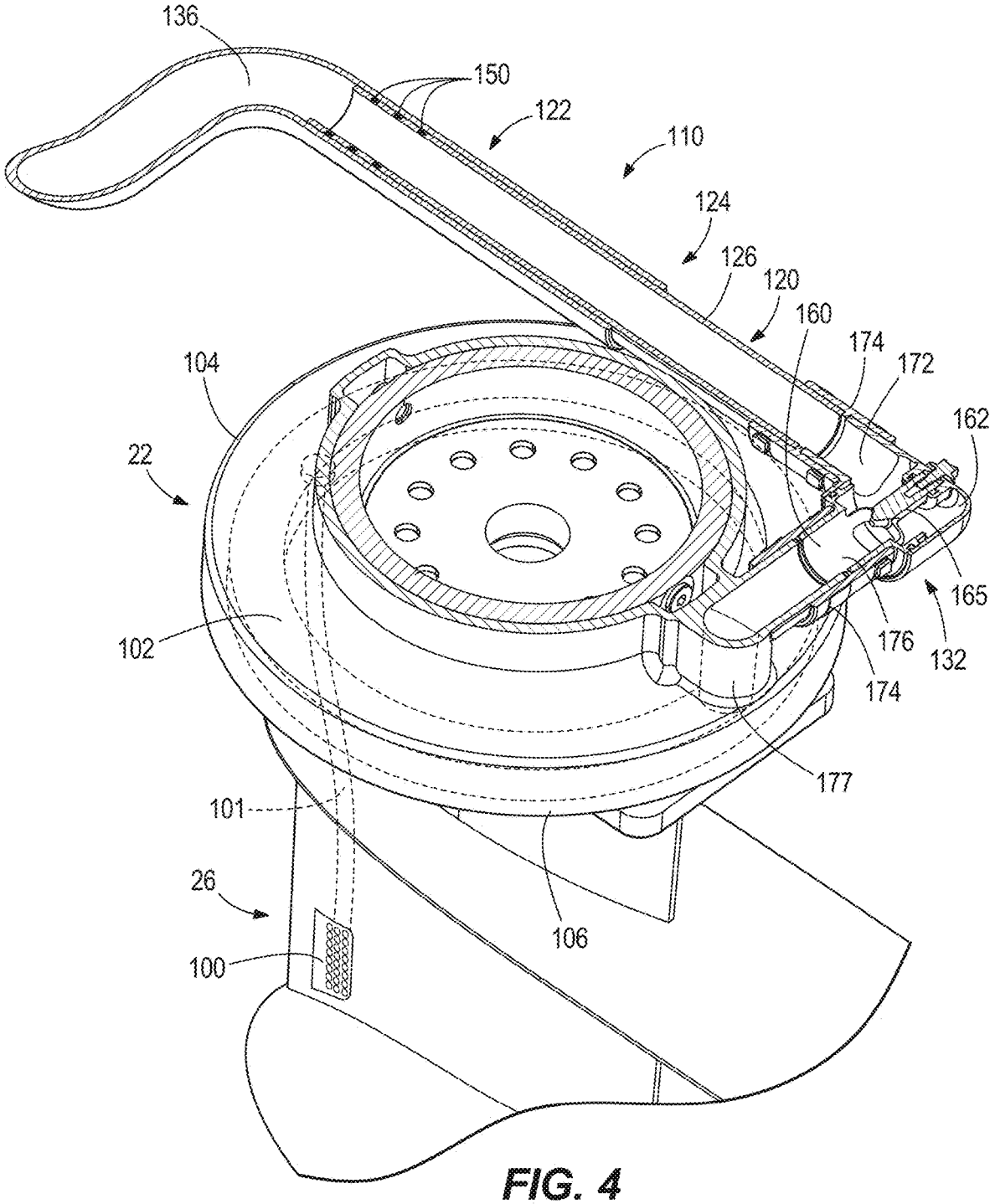
FIG. 4 is a cross sectional view of the marine drive taken at section 4-4 in FIG. 1.

Referring to FIGS. 2-4, the rigid conduit 110 extends from a first end 111 coupled to the drive assembly 20 to a second end 113 coupled to the cooling water pump 112 on the transom bracket assembly 16. The rigid cooling water conduit 110 is telescopically extendable and retractable and includes first and second conduit members 120, 122 which are slidably connected to each other. At the first end 111 of the rigid conduit 110, the first conduit member 120 is coupled to the drive assembly 20, and the second conduit member 122 of the rigid conduit 110 is coupled to the transom bracket assembly 16 at the second end 113. The first conduit member 120 and second conduit member 122 are telescopically coupled to each other to facilitate lengthening and shortening of the rigid conduit 110. The first conduit member 120 includes a first rigid hose 126 with a first end 128 pivotably coupled to the drive assembly 20 with a first swivel joint 132 and an opposite, second end 130 telescopically coupled to the second conduit member 122. The second conduit member 122 similarly includes a second rigid hose 136 with a first end 138 which is telescopically coupled to the first conduit member 120 and an opposite, second end 140 which is pivotably coupled to the transom bracket assembly 16 by a second swivel joint 142.

The first and second conduit members 120, 122 are telescopically coupled to each other at a telescoping joint 124 where a first one of the first and second rigid hoses 126, 136 extends into a different second one of the first and second rigid hoses 126, 136. In the illustrated embodiments, for example, the second end 130 of the first rigid hose 126 is slidably received in the first end 138 of the second rigid hose 136. Some embodiments, however, may be configured with the second rigid hose 136 received in the second end 130 of the first rigid hose 126. O-rings 150 are positioned in annular grooves 152 formed at the second end 130 of the first rigid hose 126. The O-rings 150 form a water-tight seal between the exterior surface of the first rigid hose 126 and the interior surface of the second rigid hose 136, thereby connecting the first conduit member 120 to the second conduit member 122. In the illustrated embodiment, the telescoping joint 124 includes three O-rings 150. Some embodiments, however, may include a different number of O-rings 150 and/or another sealing arrangement between the first and second conduit members.

To extend around the driveshaft housing 22, at least one of the first rigid hose 126 and the second rigid hose 136 may be non-linear. In the illustrated examples, the first hose 126 is generally linear while the second rigid hose 136 is non-linear. In particular, the second hose includes a lateral jog 144 between a first linear section 146 at the telescoping joint 124 and a second linear section 148 connected to the second swivel joint 142. The second linear section 148 is laterally offset from the first linear section so that the rigid conduit 110 extends around the starboard side of the marine drive 12. Some embodiments, however, may include a rigid conduit that extends around the port side of the marine drive 12. Additionally or alternatively, some embodiments may be configured with a non-linear first rigid hose 126 with, or in place of, the non-linear second rigid hose 136. Further still, some embodiments may include linear first and second rigid hoses 126, 136.

As previously mentioned, the first and second ends 111, 113 of the rigid conduit 110 are pivotably coupled to the drive assembly 20 and the transom bracket assembly 16 by first and second swivel joints 132, 142, respectively. Referring to FIGS. 2-4, each swivel joint 132, 142 includes a mounting boss 160 and a swivel housing 162 which is rotatable about the mounting boss 160 relative to a pivot axis. Each mounting boss 160 has a cylindrical body that is received by the mounting boss 160 in a nested configuration so that the swivel housing 162 rotates about the mounting boss 160. A bore 164 is formed though the end of the swivel housings 162, and fasteners 166 extend through the bores 164 to threadedly engage a mounting structure 165 at the center of the mounting boss 160. Washers 168 may be used with the fasteners 166 to ensure that the swivel housings 162 can rotate freely on the fasteners 166. An O-ring 170 is positioned in an annular groove 171 extending around the mounting boss 160 and forms a water-tight seal between an exterior surface of the mounting boss 160 and the interior surface of the swivel housing 162.

The swivel housing 162 of each swivel joint 132, 142 includes a tubular connecting segment 172 that projects radially outward from the cylindrical body of the swivel housings 162 and is connected to a corresponding end 111, 113 of the rigid conduit 110, for example by a coupler 174 and hose clamps. At the first end 111 of the rigid conduit 110, the connecting segment 172 of the first swivel housing 162 is coupled to the first end 128 of the first rigid hose 126. At the second end 113 of the rigid conduit 110, the connecting segment 172 of the second swivel housing 162 is coupled to the second end 140 of the second rigid hose 136. To link the rigid conduit 11 to the drive assembly 20, the mounting boss 160 of the first swivel joint 132 includes a connector segment 176 which is coupled to a cooling water outlet 177 of the annular cooling channel 102, for example by another coupler 174 with hose clamps. The second swivel joint 142 includes a mounting flange 178 that extends around the mounting boss 160. Bores 180 are formed through the mounting flange 178 and are engaged by fasteners 182 that couple the mounting flange 178 of the mounting boss 160 to a pump flange 184 formed around the inlet of the cooling water pump 112. Thus, the first swivel joint 132 couples the rigid conduit 110 to the drive assembly 20 and the second swivel joint 142 couples the rigid conduit 110 to the transom bracket assembly 16.

Some embodiments of a marine drive 12 may include a drain for draining water from the rigid conduit 110. For example, referring to FIGS. 3 and 8-10, the second swivel joint 142 includes a novel drain mechanism 210 for draining cooling water from the rigid cooling water conduit 110. The drain mechanism 210 includes a hollow, generally cylindrical drain body 212 extending radially outward from the side of the second swivel housing 162. A plunger 214 with a circular plunger head 220 and a plunger shaft 216 extending from the plunger head 220 is slidably received in the drain body 212. The plunger shaft 216 extends through a bore 218 formed through the side wall of the swivel housing 162 and abuts the radially outer surface of the mounting boss 160. A spring 224 is retained in the drain body 212 by a spring retainer cap 226 and biases the plunger 214 radially inward into a closed position (see FIG. 9). An O-ring 228 is positioned between the plunger head 220 and the side of the swivel housing 162 and extends around the bore 218, thereby forming water-tight a seal between the plunger 214 and the swivel housing 162 when in the closed position.

Figure 10:
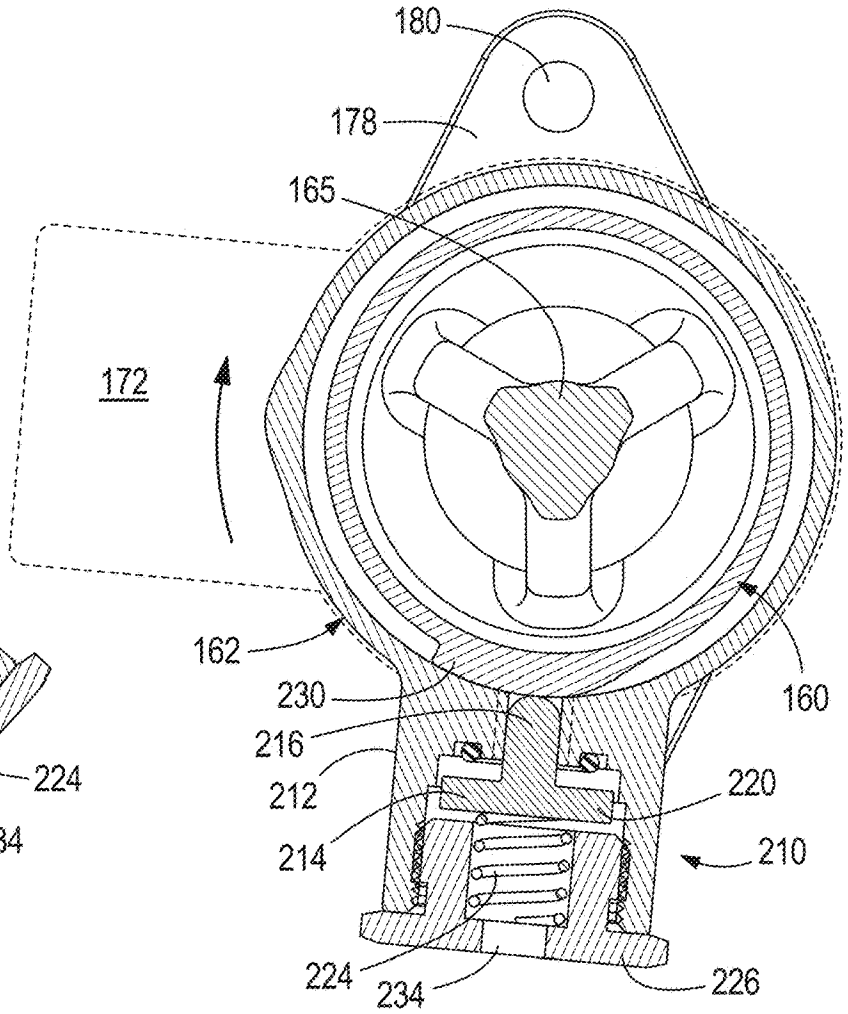
FIG. 10 is a cross sectional view of the drain mechanism of FIG. 9 in the open position.
Figure 9:
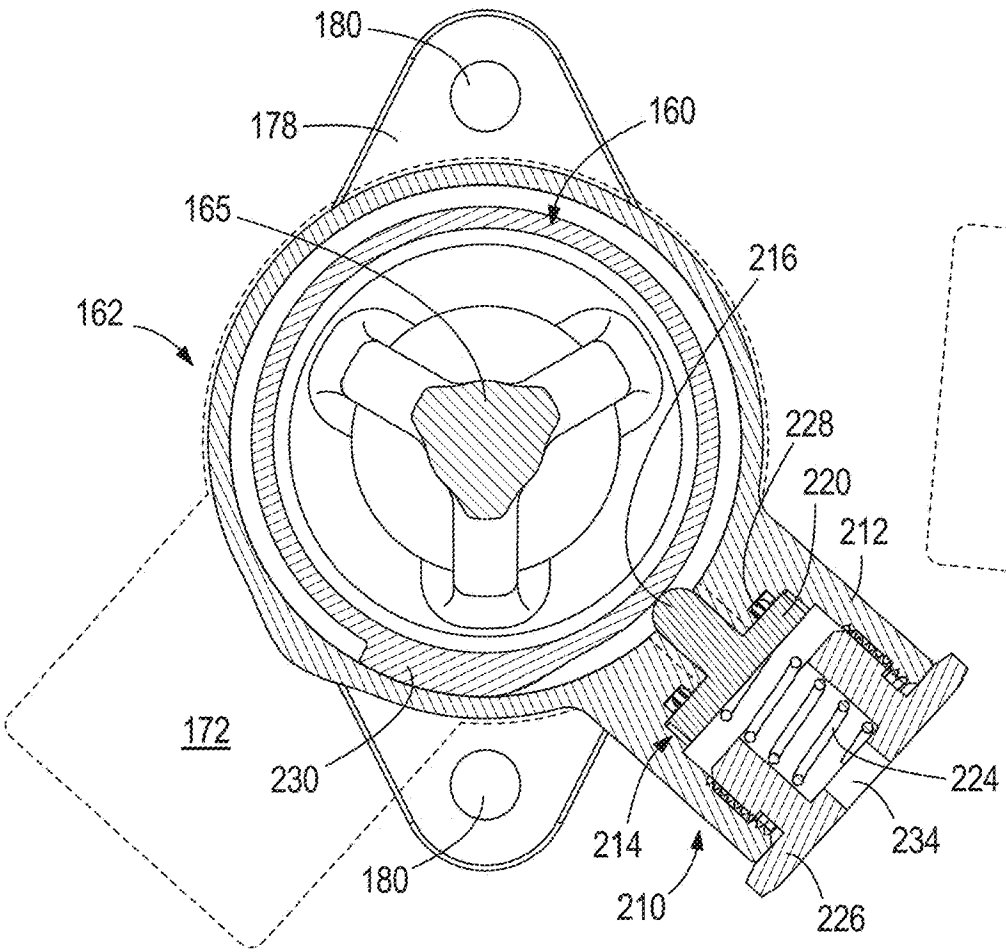
FIG. 9 is a cross sectional view of the drain mechanism in the closed position taken at section 9-9 in FIG. 9.

As best illustrated in FIGS. 9 and 10, the mounting boss 160 includes a ramp surface 230 that slopes radially outward away from the cylindrical surface of the mounting boss 160. When the swivel housing 162 is rotated in a first direction about the mounting boss 160, the plunger shaft 216 slides along the outer surface of the mounting boss 160 and into contact with the ramp surface 230, which forces the plunger 214 radially outward into an open position. When the plunger 214 is in the open position, water can flow through one or more passages 232 arranged around the bore 218, around the plunger head 220, and out the drain mechanism 210 via an outlet 234 formed in the spring retainer cap 226 (see FIG. 10). Rotating the swivel housing 162 about the mounting boss 160 in the second direction moves the plunger 214 out of contact with the ramp surface 230, which permits the spring 224 to push the plunger 214 back into the closed position.

When the cooling system is in operation, the pump motor 115 drives the pump rotors 117 of the cooling water pump 112 (see FIG. 5) to draw water into the cooling system and to the heat exchanger 114. Water is drawn into the cooling system through the intake inlet 100 on the gearcase housing 26 and up to the annular cooling channel 102 via the internal conduit 101. As best illustrated in FIG. 4, the water is drawn from the internal conduit 101, around the annular cooling channel 102, and out of the driveshaft housing 22 via the cooling water outlet 177. The water then travels into the rigid conduit 110 via the first swivel joint 132 and through the first rigid hose 126 and the second rigid hose 136. Referring to FIG. 5, water is then drawn out of the rigid conduit 110, through the second swivel joint 142, and into the cooling water pump 112. The cooling water pump 112 then pumps the water into the heat exchanger 114 in order to cool the cooling fluid in the closed cooling loop.

The telescoping joint 124 of the rigid cooling water conduit 110 advantageously allows a user to trim the drive assembly 20 without disconnecting or manually adjusting the rigid conduit 110. Referring to FIGS. 6 and 7 (which omits the starboard trim cylinder 60 to clearly illustrate the rigid conduit 110), the marine drive 12 can be trimmed up from the lowered position (FIG. 6) to the raised position (FIG. 7) by extending the trim cylinders 60. As the trim cylinders 60 extend, the rigid conduit 110 is lengthened upon trimming the drive assembly 20 up relative to the transom bracket assembly 16. In particular, the first rigid hose 126 slides out of the second rigid hose 136, thereby increasing the length of the rigid conduit 110 at the telescoping joint 124. When the drive assembly 20 is lowered, the first rigid hose 126 slides back into the second rigid hose 136 to decrease the length of the rigid conduit 110. Thus, the telescoping joint 124 facilitates the lengthening of the rigid cooling water conduit 110 upon trimming of the drive assembly 20 up relative to the transom bracket assembly 16, as well as the shortening of the rigid cooling water conduit 110 upon trimming of the drive assembly 20 down relative to the transom bracket assembly 16.

In addition to extending the telescoping joint 124, trimming the drive assembly 20 up relative to the transom bracket assembly 16 automatically opens the drain mechanism 210 and permits cooling water to drain by gravity from the rigid cooling water conduit 110. This may be useful, for example, in order to drain any cooling water from the marine drive 12 without manually opening an outlet and/or disconnecting the rigid conduit 110. As the drive assembly 20 is raised, the angle of the rigid conduit 110 relative to the transom bracket assembly 16 and the drive assembly 20 changes as the first end 111 of the rigid conduit 110 pivots at the first swivel joint 132 and the second end 113 of the rigid conduit 110 pivots at the second swivel joint 142. As the rigid conduit 110 rotates, the swivel housing 162 of the second swivel joint 142 rotates about the mounting boss 160. The shaft 216 of the plunger 214 slides along the surface of the mounting boss 160 and onto the ramp surface 230, thereby pushing the plunger 214 radially outward into the open position against the force of the spring 224. As illustrated in FIG. 7, the drain mechanism 210 is positioned at the lowest point of the cooling loop while the drive assembly 20 is raised, allowing the cooling water to drain from the cooling system through the drain mechanism 210. As the drive assembly is lowered, the plunger shaft 216 slides down the ramp surface 230 and the spring 224 biases the drain mechanism 210 back into the closed position.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples which occur to those skilled in the art. Such other examples are intended to be within the scope of the claims if they have features or structural elements which do not differ from the literal language of the claims, or if they include equivalent features or structural elements with insubstantial differences from the literal languages of the claims.

What is claimed is:

1. A marine drive for propelling a marine vessel in a body of water, the marine drive comprising:

a transom bracket assembly configured to mount the marine drive to the marine vessel, a drive assembly coupled to the transom bracket assembly and configured to generate a thrust force in the body of water, the drive assembly being trimmable up and down relative to the transom bracket assembly, a cooling water pump configured to pump cooling water from the body of the water for cooling at least one component of the marine drive, and a rigid cooling water conduit extending outside of the drive assembly and the transom bracket assembly, the rigid cooling water conduit being configured to convey the cooling water from the drive assembly for cooling at least one component of the marine drive.

2. A marine drive for propelling a marine vessel in a body of water, the marine drive comprising:

a transom bracket assembly configured to mount the marine drive to the marine vessel, a drive assembly coupled to the transom bracket assembly and configured to generate a thrust force in the body of water, the drive assembly being trimmable up and down relative to the transom bracket assembly, a cooling water pump configured to pump cooling water from the body of the water for cooling at least one component of the marine drive, and a rigid cooling water conduit extending from the drive assembly to the transom bracket assembly, the rigid cooling water conduit being configured to convey the cooling water from the drive assembly for cooling at least one component of the marine drive, wherein the rigid cooling water conduit is lengthened upon trimming of the drive assembly up relative to the transom bracket assembly and wherein the rigid cooling water conduit is shortened upon trimming of the drive assembly down relative to the transom bracket assembly.

3. A marine drive for propelling a marine vessel in a body of water, the marine drive comprising:

a transom bracket assembly configured to mount the marine drive to the marine vessel, a drive assembly coupled to the transom bracket assembly and configured to generate a thrust force in the body of water, the drive assembly being trimmable up and down relative to the transom bracket assembly, a cooling water pump configured to pump cooling water from the body of the water for cooling at least one component of the marine drive, and a rigid cooling water conduit extending from the drive assembly to the transom bracket assembly, the rigid cooling water conduit being configured to convey the cooling water from the drive assembly for cooling at least one component of the marine drive, wherein the rigid cooling water conduit is telescopically extendable and retractable.

4. A marine drive for propelling a marine vessel in a body of water, the marine drive comprising:

a transom bracket assembly configured to mount the marine drive to the marine vessel, a drive assembly coupled to the transom bracket assembly and configured to generate a thrust force in the body of water, the drive assembly being trimmable up and down relative to the transom bracket assembly, a cooling water pump configured to pump cooling water from the body of the water for cooling at least one component of the marine drive, and a rigid cooling water conduit extending from the drive assembly to the transom bracket assembly, the rigid cooling water conduit being configured to convey the cooling water from the drive assembly for cooling at least one component of the marine drive, wherein the rigid cooling water conduit comprises a first conduit member coupled to the drive assembly and a second conduit member coupled to the transom bracket assembly, wherein the first conduit member and second conduit member are telescopically coupled to each other to facilitate lengthening and shortening of the rigid cooling water conduit upon trimming of the drive assembly relative to the transom bracket assembly.

5. The marine drive according to claim 4, wherein the first conduit member comprises a first rigid hose and wherein the second conduit member comprises a second rigid hose, and wherein a first one of the first and second rigid hoses extends into a different second one of the first and second rigid hoses at a telescoping joint.

6. The marine drive according to claim 5, wherein the first rigid hose comprises a first end pivotably coupled to the drive assembly and an opposite, second end telescopically coupled to the second rigid hose.

7. The marine drive according to claim 6, wherein the second rigid hose comprises a first end which is telescopically coupled to the first rigid hose at a telescoping joint and an opposite, second end which is pivotably coupled to the transom bracket assembly.

8. The marine drive according to claim 7, wherein at least one of the first and second rigid hoses is non-linear.

9. A marine drive for propelling a marine vessel in a body of water, the marine drive comprising;

a transom bracket assembly configured to mount the marine drive to the marine vessel, a drive assembly coupled to the transom bracket assembly and configured to generate a thrust force in the body of water, the drive assembly being trimmable up and down relative to the transom bracket assembly, a cooling water pump configured to pump cooling water from the body of the water for cooling at least one component of the marine drive, and a rigid cooling water conduit extending from the drive assembly to the transom bracket assembly, the rigid cooling water conduit being configured to convey the cooling water from the drive assembly for cooling at least one component of the marine drive, wherein the rigid cooling water conduit has a first end which is pivotably coupled to the drive assembly and an opposite, second end which is pivotably coupled to the transom bracket assembly.

10. The marine drive according to claim 9, further comprising a first swivel joint which pivotably couples the rigid cooling water conduit to the drive assembly and a second swivel joint which pivotably couples the rigid cooling water conduit to the transom bracket assembly.

11. The marine drive according to claim 10, wherein at least one of the first swivel joint and the second swivel joint comprises a mounting boss and a swivel housing which is rotatable about the mounting boss relative to a pivot axis.

12. A marine drive for propelling a marine vessel in a body of water, the marine drive comprising:

a transom bracket assembly configured to mount the marine drive to the marine vessel, a drive assembly coupled to the transom bracket assembly and configured to generate a thrust force in the body of water, the drive assembly being trimmable up and down relative to the transom bracket assembly, a cooling water pump configured to pump cooling water from the body of the water for cooling at least one component of the marine drive, a rigid cooling water conduit extending from the drive assembly to the transom bracket assembly, the rigid cooling water conduit being configured to convey the cooling water from the drive assembly for cooling at least one component of the marine drive, and a drain mechanism for draining cooling water from the rigid cooling water conduit, wherein the drain mechanism is configured such that trimming the drive assembly up relative to the transom bracket assembly automatically opens the drain mechanism and permits cooling water to drain by gravity from the rigid cooling water conduit.

13. The marine drive according to claim 12, further comprising a swivel joint which pivotably couples the rigid cooling water conduit to the transom bracket assembly, swivel joint comprises the drain mechanism.

14. The marine drive according to claim 13, wherein the swivel joint comprises a mounting boss and a swivel housing which is rotatable about the mounting boss, and wherein trimming the drive assembly up relative to the transom bracket assembly rotates the swivel housing in a first direction about the mounting boss, which opens the drain mechanism, and wherein trimming the drive assembly down relative to the transom bracket assembly rotates the swivel housing in an opposite, second direction about the mounting boss, which closes the drain mechanism.

15. The marine drive according to claim 14, wherein the drain mechanism is spring-biased into a closed position.

16. The marine drive according to claim 14, wherein the drain mechanism comprises a plunger and a spring, wherein rotating the swivel housing in the first direction moves the plunger against the spring into an open position and wherein rotating the swivel housing in the second direction permits the spring to move the plunger into a closed position.

17. The marine drive according to claim 16, wherein the mounting boss comprises a ramp surface and wherein rotating the swivel housing in the first direction brings the plunger into contact with the ramp surface, which forces the plunger into the open position and wherein rotating the swivel housing in the second direction moves the plunger out of contact with the ramp surface, which permits the spring to move the plunger into the closed position.

18. A marine drive for propelling a marine vessel in a body of water, the marine drive comprising:

a transom bracket assembly configured to mount the marine drive to the marine vessel, a drive assembly coupled to the transom bracket assembly and configured to generate a thrust force in the body of water, the drive assembly being trimmable up and down relative to the transom bracket assembly, a cooling water pump coupled to the transom bracket assembly, the cooling water pump being configured to pump cooling water from the body of the water for cooling at least one component of the marine drive, a cooling water conduit extending from the drive assembly to the transom bracket assembly, the cooling water conduit being configured to convey the cooling water from the drive assembly to the cooling water pump; and a drain mechanism for draining cooling water from the drive assembly and cooling water conduit, wherein trimming the drive assembly up relative to the transom bracket assembly opens the drain mechanism, and wherein trimming the drive assembly down relative to the transom bracket assembly closes the drain mechanism.

19. The marine drive according to claim 18, further comprising a swivel joint which pivotably couples the cooling water conduit to the transom bracket assembly, swivel joint comprises the drain mechanism, wherein the swivel joint comprises a mounting boss and a swivel housing which is rotatable about the mounting boss, and wherein trimming the drive assembly up relative to the transom bracket assembly rotates the swivel housing in a first direction about the mounting boss, which opens the drain mechanism, and wherein trimming the drive assembly down relative to the transom bracket assembly rotates the swivel housing in an opposite, second direction about the mounting boss, which closes the drain mechanism.

20. A cooling water conduit for conveying cooling water in a marine drive having a drive assembly and a transom bracket assembly, the cooling water conduit comprising:

a first conduit member and a second conduit member coupled to the first conduit member via a telescopic joint which facilitates lengthening of the cooling water conduit upon trimming of the drive assembly up relative to the transom bracket assembly and facilitates shortening of the cooling water conduit upon trimming of the drive assembly down relative to the transom bracket assembly;

a first swivel joint for pivotably coupling the cooling water conduit to the drive assembly and a second swivel joint for pivotably coupling the cooling water conduit to the transom bracket assembly;

a drain mechanism for draining cooling water from the cooling water conduit, wherein the drain mechanism is configured such that trimming the drive assembly up relative to the transom bracket assembly automatically opens the drain mechanism and permits cooling water to drain by gravity from the cooling water conduit.

* * * * *